US011562853B2

(12) United States Patent
Griebler et al.

(10) Patent No.: US 11,562,853 B2
(45) Date of Patent: Jan. 24, 2023

(54) HIGH VOLTAGE DIRECT CURRENT ENERGY TRANSMISSION (HVDCT) AIR-CORE INDUCTOR, AND METHOD FOR MANUFACTURING THE HVDCT AIR-CORE INDUCTOR

(71) Applicant: Siemens Energy Global GmbH & Co. KG, Munich (DE)

(72) Inventors: Peter Griebler, Hargelsberg (AT); Steffen Lang, Hallerndorf (DE); Stephan Rauchenzauner, Linz (AT)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 456 days.

(21) Appl. No.: 16/092,386

(22) PCT Filed: Apr. 20, 2017

(86) PCT No.: PCT/EP2017/059411
§ 371 (c)(1),
(2) Date: Oct. 9, 2018

(87) PCT Pub. No.: WO2017/182577
PCT Pub. Date: Oct. 26, 2017

(65) Prior Publication Data

US 2019/0096570 A1 Mar. 28, 2019

(30) Foreign Application Priority Data

Apr. 22, 2016 (AT) ..... A 50358/2016

(51) Int. Cl.
*H01F 27/32* (2006.01)
*H01F 37/00* (2006.01)
(Continued)

(52) U.S. Cl.
CPC ..... *H01F 27/32* (2013.01); *H01F 27/36* (2013.01); *H01F 27/363* (2020.08);
(Continued)

(58) Field of Classification Search
CPC .... H01F 27/288; H01F 27/2885; H01F 27/32; H01F 27/323; H01F 27/343; H01F 27/36;
(Continued)

(56) References Cited

U.S. PATENT DOCUMENTS 4,137,515 A * 1/1979 Akao ..... H01F 5/06 336/205
9,129,801 B2 9/2015 Fleischhaker et al.
(Continued)

FOREIGN PATENT DOCUMENTS

CN 2192946 Y 3/1995
CN 1665872 9/2005
(Continued)

OTHER PUBLICATIONS

PCT International Search Report based on PCT/EP2017/059411 dated Aug. 2, 2017.
(Continued)

*Primary Examiner* — Tszfung J Chan
(74) *Attorney, Agent, or Firm* — Cozen O'Connor

(57) ABSTRACT

A high voltage direct current energy transmission (HVDCT) air-core inductor includes at least one concentric winding layer having electric terminals are formed at its ends, and includes an electrostatic shield that has a layer of electrostatically dissipative material having a surface resistance ranging from 109 to 1014 ohm/square, wherein at least one end of the layer is provided with a collector electrode that extends essentially along the circumference of the end of the layer and that is to be connected to one of the terminals, and
(Continued)

where the layer is designed as a spray coating on an outer surface of an exterior winding layer.

11 Claims, 4 Drawing Sheets

(51) Int. Cl.
*H01F 27/36* (2006.01)
*H01F 41/04* (2006.01)

(52) U.S. Cl.
CPC ..... *H01F 37/005* (2013.01); *H01F 41/043* (2013.01); *H01F 2027/329* (2013.01)

(58) Field of Classification Search
CPC ..... H01F 27/361; H01F 27/363; H01F 2027/329; H01F 37/005
USPC ..... 336/55, 57, 60, 62, 185, 199, 207, 84 R, 336/84 C, 84 M
See application file for complete search history.

(56) References Cited

U.S. PATENT DOCUMENTS

| | | | | |
|---|---|---|---|---|
| 2002/0066881 | A1* | 6/2002 | Koppe | H05K 9/0083 252/62.54 |
| 2006/0084719 | A1 | 4/2006 | Huber | |
| 2008/0070788 | A1* | 3/2008 | Kramer | H01F 6/06 505/191 |
| 2011/0043320 | A1* | 2/2011 | Reisinger | H01F 27/343 336/84 R |
| 2016/0019996 | A1* | 1/2016 | Ghosh | C08K 3/22 252/516 |
| 2016/0285354 | A1* | 9/2016 | Handy | H01F 27/323 |
| 2017/0278606 | A1* | 9/2017 | Kondou | H01F 27/36 |

FOREIGN PATENT DOCUMENTS

| | | | | |
|---|---|---|---|---|
| CN | 2919481 | Y | 7/2007 | |
| CN | 201638663 | U | 11/2010 | |
| CN | 201765936 | U | 3/2011 | |
| CN | 102007552 | | 4/2011 | |
| CN | 102256426 | | 11/2011 | |
| CN | 102460641 | | 5/2012 | |
| CN | 203288409 | U | 11/2013 | |
| CN | 204792370 | U | 11/2015 | |
| CN | 108701534 | | 10/2018 | |
| CN | 109074944 | | 12/2018 | |
| DE | 4438187 | A1 * | 5/1996 | H02K 3/40 |
| DE | 102012205563 | | 10/2013 | |
| DE | 102012205563 | A1 * | 10/2013 | H01B 3/40 |
| DE | 102014213944 | | 1/2016 | |
| DE | 102014213944 | A1 * | 1/2016 | H01H 33/662 |
| EP | 2266122 | | 12/2010 | |
| EP | 2866235 | | 4/2015 | |
| FR | 2784787 | | 4/2001 | |
| GB | 1156369 | | 6/1969 | |
| JP | 58095808 | A * | 6/1983 | H01F 41/127 |
| WO | WO2012/093052 | | 7/2012 | |
| WO | WO2012/093053 | | 7/2012 | |
| WO | WO 2017/140482 | | 8/2017 | |
| WO | WO 2017/140577 | | 8/2017 | |

OTHER PUBLICATIONS

Office Action dated Jan. 27, 2021 issued in Chinese Patent Application No. 201780024937.4.
Office Action dated Jun. 28, 2021 issued in Chinese Patent Application No. 201780024937.4.

* cited by examiner

HIGH VOLTAGE DIRECT CURRENT ENERGY TRANSMISSION (HVDCT) AIR-CORE INDUCTOR, AND METHOD FOR MANUFACTURING THE HVDCT AIR-CORE INDUCTOR

CROSS-REFERENCE TO RELATED APPLICATIONS

This is a U.S. national stage of Application No. PCT/EP2017/059411 filed Apr. 20, 2017. Priority is claimed on AT Application No. A50358/2016 filed Apr. 22, 2016, the content of which is incorporated herein by reference in its entirety.

BACKGROUND OF THE INVENTION

1. Field of the Invention

The invention relates in general to the technical field of transmitting electrical energy via high direct voltage, in particular an High Voltage direct Current Energy Transmission (HVDCT) air-core inductor and a method for manufacturing HVDCT air-core inductor.

2. Description of the Related Art

For the transmission of electrical energy at high power, from about 1000 MW upwards, the transmission capacity has a limiting effect over a particular line length since the reactive power barely permits economical operation. In this power range, "high voltage direct current energy transmission" systems (HVDCT) have long been in use in a variety of application fields. Components of such an HVDCT system can be, for example, HVDCT smoothing reactors or HVDCT filter chokes. These components are typically at a very high electrical potential relative to earth, for example 500-800 kV. Typically, these components are arranged outside. As a result, they are exposed to the environmental conditions prevailing there, such as rain water and dirt. Depending upon the environment, dirt particles can become deposited on the outer surface of such an HVDCT component and, with an irregular accumulation, can lead to a distortion of the electric field along a component. A partial discharging can occur on the HVDCT component. Ions can arise which in turn act attractively on ionized and polarized particles in the direct vicinity. At the exterior layer of the coil of such an HVDCT smoothing reactor or filter choke, with these particles an electric charge with opposite polarity is built up, which either flows away to the terminals or dissipates by discharging on the surface of the coil and accumulates there. The at least partially electrically conductive structure thereby arising at the surface of such an HVDCT component can impair the operational behavior. In the literature, this is referred to with the expression "black spot phenomenon". The conductive structure that forms on the surface of the HVDCT component can lead to an electric flashover. In the worst case, the "black spot phenomenon" can, for example, result in a total failure of an HVDCT smoothing reactor or HVDCT filter choke.

In order to counteract this undesirable electrostatic contamination, EP 2 266 122 B1 describes an electrostatic shielding for an HVDCT component which is made of a covering with a foil made of electrostatically dissipative material having a surface resistance in the range of $10^9$ to $10^{14}$ ohm/square. The covering is electrically connected to a terminal of the HVDCT component. With such a semiconducting foil on the outer surface of the coil, it is possible to conduct charge carriers away from the surface of the component and thus to prevent an electrostatic charging of the component with the aforementioned negative consequences. In order to be able to apply semiconducting foil to the coil, the substrate must previously be prepared for a procedure of gluing the foil. This can take place, for example, via a "dummy package" in that the outermost layer of the coil of the HVDCT component is initially wound round with a textile blended fabric band. Subsequently, the blended fabric band is soaked or impregnated with epoxy resin. Following the curing of the epoxy resin, a polyurethane paint is sprayed on. This polyurethane paint is roughened to prepare the adhesion surface. Subsequently, the foil coated with a semiconducting layer is glued onto the roughened polyurethane paint surface. In a last process step, a cover layer is applied for protection. The material for this cover layer can be a silicone that cross-links at room temperature. The construction of such a "dummy package" thus consists of a plurality of layers. The manufacturing is complex. However, the application of the blended fabric band is both a labor-intensive and a material-intensive process step. Secondly, the self-adhesive foil is expensive because the foil must withstand ultraviolet radiation over a long operating life. The roughening of the paint surface that is required for the gluing process is also labor-intensive and additionally causes dust that is hazardous to health.

In view of the foregoing, there is therefore a need for an HVDCT air-core inductor that is resistant to the "black spot phenomenon" and is also producible simply and economically.

SUMMARY OF THE INVENTION

It is an object of the present invention to provide a high voltage direct current energy transmission (HVDCT) air-core inductor and a method for its production that is constructed as simply as possible and is economic to produce.

This and other objects and advantages are achieved in accordance with the invention by an HVDCT air-core inductor and for method, where in accordance with a fundamental concept of the invention, in an HVDCT component, the formation of an electrostatic screening is achieved not by gluing a foil, but by applying a semiconducting lacquer onto the lateral surface of an outer winding layer. This application occurs via a spraying process. Through the spraying process, a surface film is sprayed onto the coil surface, the electrical conduction property of which corresponds substantially to the previously used foil. In other words, the "dissipative" material properties of the semiconducting layer manufactured in EP 2 266 122 B1 by gluing a semiconducting layer produced as a foil is now achieved with a semiconducting layer manufactured by spraying. This spray coating now provides for the conduction away of charge carriers that form during operation on the surface of the HVDCT component. As a result, an electrostatic charging of the component is thereby also effectively counteracted. The great advantage lies in the more economical production and the evenness of the screening effect.

In accordance with the invention, an HVDCT air-core inductor therefore has a coating for the purpose of electrostatic screening, which has been formed by atomization of a material, i.e., a semiconducting paint. In that this semiconducting layer is "sprayed" directly onto the surface of the coil conductor, the "black spot phenomenon" can be very simply and effectively counteracted. During the manufacturing, many cost-intensive process steps can be dispensed with. That is, an expensive UV stabilized, self-adhesive foil is dispensed with. Thus, a complex surface treatment that is necessary for the glue-connection of the foil is also dispensed with. The labor-intensive application of a textile blended fabric band as a substrate for gluing is also no longer required. The coating surface is no longer roughened. Consequently, no grinding dust also arises which could be hazardous to health.

It is particularly advantageous that the layer for electrostatic screening can be produced. very simply, evenly, and therefore economically. In contrast to the previously required foil, with spray coating, there is no abutment site or overlap of a semiconducting layer. The conducting away effect is the same over the entire surface. Fewer process steps are required during the manufacturing. Overall, the manufacturing process is more economical.

It has been found that with an evenly applied screening layer that has a thickness of approximately 80 μm to 120 μm, the "black spot phenomenon" can be efficiently counteracted. Such a screening layer can be produced easily and with little cost through spray coating.

The electrical property of this semiconducting layer can be pre-set by suitable filler materials, i.e., conductive particles, within broad limits. Conductive particles can be formed via dielectric, platelet-shaped substrates that are each covered by an electrically conductive layer. Suitable materials for a substrate are, for example, natural or synthetic mica, aluminum oxide, silicon oxide or glass, or mixtures thereof. The electrically conductive layer of a particle can consist of a doped metal oxide.

With regard to low manufacturing costs, it can be favorable if the material atomized in the spraying procedure is a polymer with embedded semiconducting filler materials. An epoxy resin or a polyurethane or a silicone or a polyester are suitable as the polymer.

Preferable is a filler material which is formed of a metal oxide or a silicon carbide.

Advantageously, the filler material is a doped metal oxide or a doped silicon carbide.

A filler material has been found to be particularly preferable which is composed proportionally of particles of undoped silicon carbide and particles of a tin oxide doped with antimony.

It is also an object of the invention to provide a method that solves the problem set out in the introduction, i.e., a method for manufacturing a component for an HVDCT exterior installation where, on the externally arranged lateral surface of an exterior winding layer, a semiconducting layer is applied directly via an injection or spraying method. With this, conventionally required process steps can be dispensed with, such that the manufacturing costs are comparatively lower.

The method in accordance with the invention for producing an HVDCT air-core inductor is characterized in that in a first method step, a concentric winding arrangement is provided and subsequently, the outer lateral surface of the winding arrangement is formed coated with a spray coating method in which a layer of a semiconducting paint formed from an electrostatically dissipative material having a surface resistance in the region from $10^9$ to $10^{14}$ ohm/square is applied.

Particularly advantageously, for this spray coating method, the so-called "high volume low pressure" (HVLP) method is used. With this low pressure spraying method, a rapid and efficient painting of large areas is possible. The atomization occurs due to compressed air at a pressure of 3-4 bar. It is advantageous herein that comparatively little spray mist is created. The manufacturing method is therefore environmentally favorable.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For the further explanation of the invention, in the following part of the description, reference is made to drawings in which advantageous embodiments, details and developments of the invention are disclosed on the basis of a non-restrictive exemplary embodiment, in which.

DETAILED DESCRIPTION OF THE EXEMPLARY EMBODIMENTS

Figure 1:
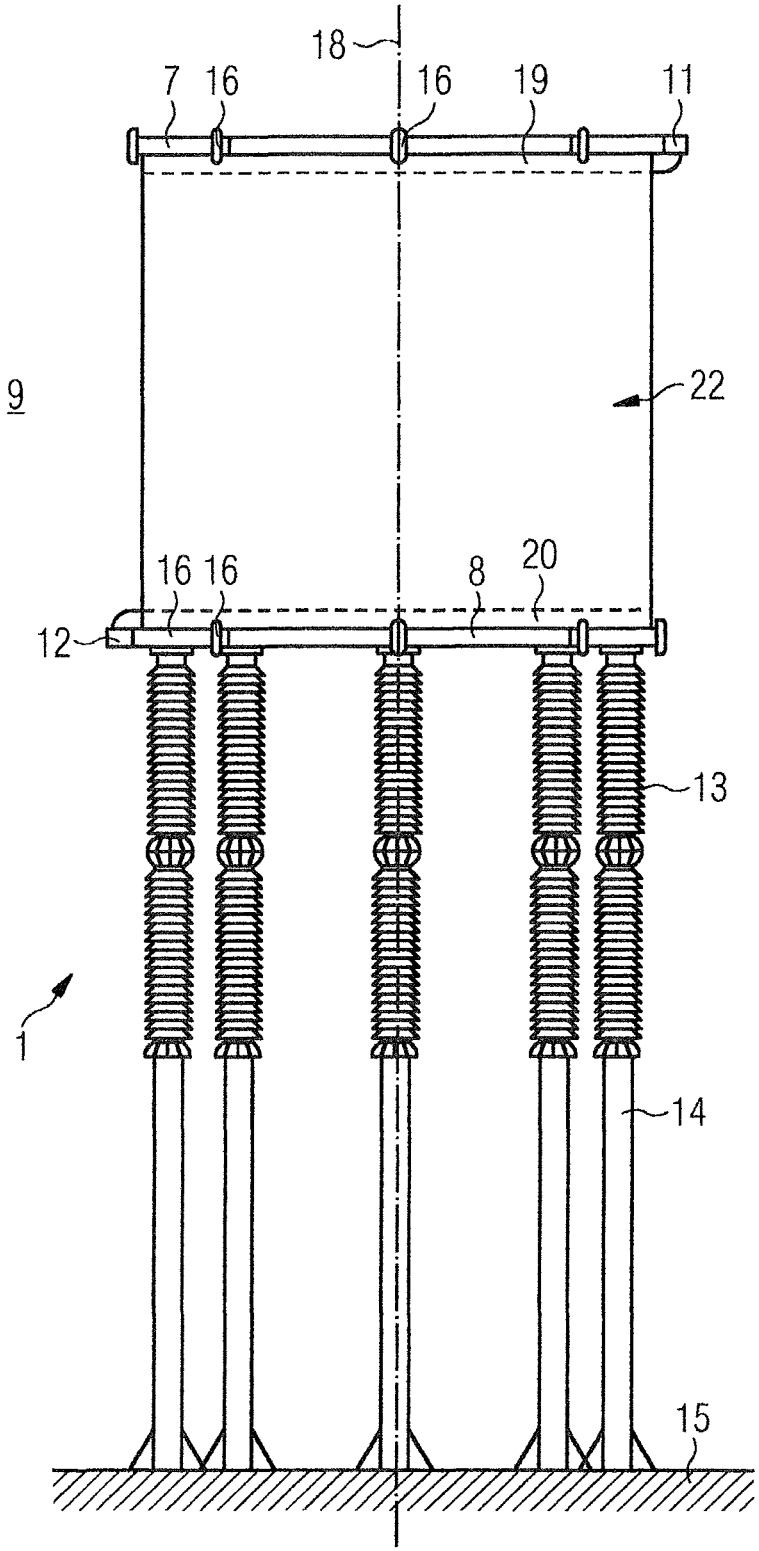
FIG. 1 is an HVDCT air-core inductor in accordance with the invention in a side view.

FIG. 1 shows an HVDCT air-core inductor 1 such as those typically used for high voltage direct current transmission (HVDCT) as smoothing reactors. The operation of such an HVDCT air-core inductor 1 typically occurs outside, and it is therefore also exposed to the prevailing outdoor weather conditions. The drawing in FIG. 1 shows the air-core inductor 1 in a vertically arranged position that is supported by insulators 13 and a steel construction 15 on a base or on the ground 15.

During operation, the air-core inductor 1 is at a high electrical potential relative to earth, for example, 500-800 kV and carries a current of up to 4000 A. The voltage drop across the air-core inductor 1, i.e., between the electrical connections 11 and 12 is lower in comparison thereto and corresponds approximately to the residual ripple of the voltage to be smoothed, typically approximately 100 V up to a few kV. Only in the event of transient events, such as switching processes or a lightning strike, can there be a significant voltage drop across the air-core inductor 1 itself, which the insulation of its windings must be able to withstand.

Figure 2:
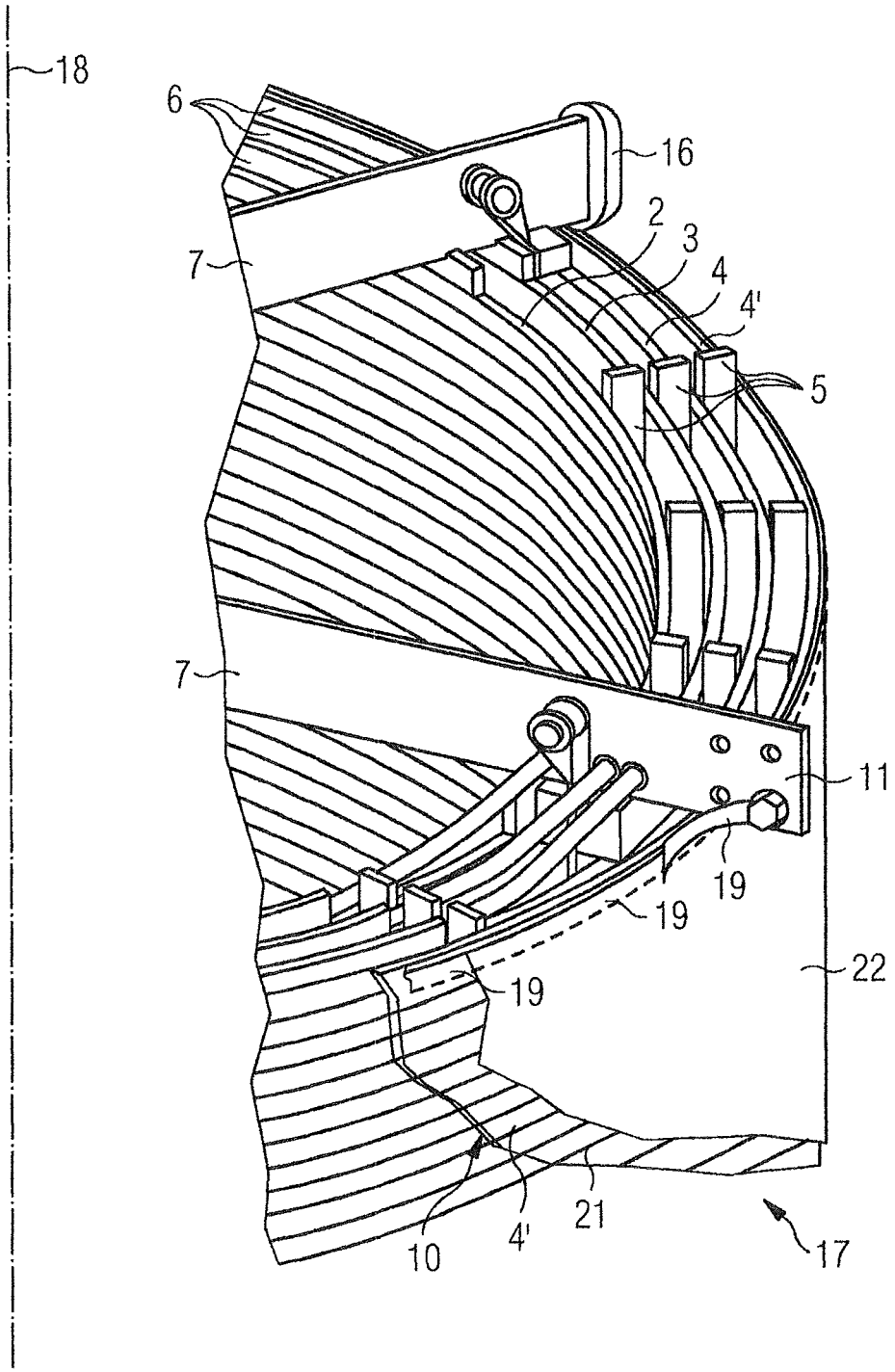
FIG. 2 is a detail representation taken from FIG. 1 with a view of the upper end side of the HVDCT air-core inductor, such that a part of the winding arrangement is seen in a perspective illustration.

As shown in FIG. 2, the air-core inductor 1 comprises an electrical winding arrangement with a coil conductor 10 wound helically about the axis 18. The individual layers 2, 3, 4 and 4' of the conductor 10 are held at a radial spacing by a spider 7, 8. Provided at each end, on each spider 7, 8, is a screening cap 16 so that the action of points effect is reduced.

Due to the high electrical potential of the air-core inductor 1, a strong electrostatic field forms between the exterior of the air-core inductor 1 and the ground 15. This potential can lead to charge carriers from the surroundings 9 forming on the lateral surface of the choke 1 with the consequences, as set out in the introduction, of an electrostatic contamination or the formation of "black spots". In order to counteract this "black spot phenomenon", the air-core inductor 1 is provided with an electrostatic screening. This electrostatic screening has conventionally been realized with a self-adhesive semiconducting foil which, however, is now replaced in accordance with the invention with a layer 22 that is sprayed directly onto the outer winding layer and is described in detail below.

FIG. 2 shows a detailed view taken from FIG. 1, looking toward the upper end side of the HVDCT air-core inductor, so that a part of the winding arrangement is visible in a spatial representation. The semiconducting layer 22 is sprayed onto the outer lateral surface 21 in the form of a paint coating (see also FIG. 4). It is evident from FIG. 2 that the individual winding layers 2, 3, 4, 4' of the air-core inductor 1 are separated from one another by air gaps 6. The spider 7 holds these winding layers 2, 3, 4, 4' at a spacing. Spacers 5 define the spacing of the individual winding layers 2, 3, 4, 4' from one another. At the end side, the spiders 7 are provided with a screening cap 16.

Figure 3:
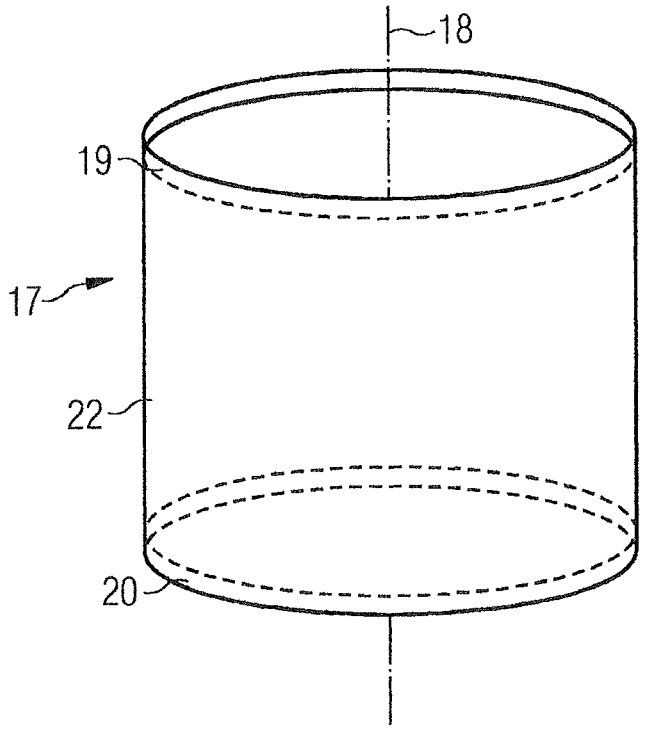
FIG. 3 is the electrostatic screening of the HVDCT air-core inductor of FIG. 1 in a perspective view.

FIG. 3 shows the electrostatic screening 17 of the HVDCT air-core inductor separately therefrom. The electrostatic screening 17 consists substantially of the hollow cylindrical layer 22 and at the end side, collector electrodes 19, 20 encircling the circumference. The layer 22 was/is manufactured by spraying. Using a spray pistol, a semiconducting polyurethane paint was/is atomized in a spray pistol and sprayed at an air pressure of 3-4 bar externally onto the lateral surface of the winding layer 4'. During the spraying process, the spacing between the spray pistol axis 18 and the coil 1 was/is kept constant. In this way, with an automated spraying apparatus, an electrically semiconducting coating 22 with an even layer thickness of 80-120 μm can be created on the outer circumferential surface of the winding layer 4'.

The coating 22 has collector electrodes 19, 20 on the end side, each extending around the circumference. These collector electrodes 19, 20 are conductively connected to the electrical terminals 11, 12 of the air-core inductor 1.

The semiconducting layer 22 comprises a polymer substance that contains a filler material, in the form of electric semiconducting solid particles or pigments that are embedded in the polymer material. The electric conductivity of the particles can be varied within broad limits by doping their material. Through doping or bringing together particles and matrix material, a resistive coating 22 with a surface resistance in a range between $10^9$ and $10^{14}$ ohm/square can be made. The layer 22 acts, as mentioned, as electrostatic screening. With the electrically semiconducting layer 22, it is achieved that the charge carriers impinging upon the air-core inductor 1 from the exterior 9 pass "dissipatively" by the shortest route to the nearest collector electrode 19 or 20 and from there are conducted away to one of the terminals 11 or 12. By conducting away these charge carriers, the risk of the formation of a conductive structure on the exterior of the air gap choke 2 and therefore of a surface leakage current is lessened. The disadvantages mentioned in the introduction can thus be largely prevented.

Figure 4:
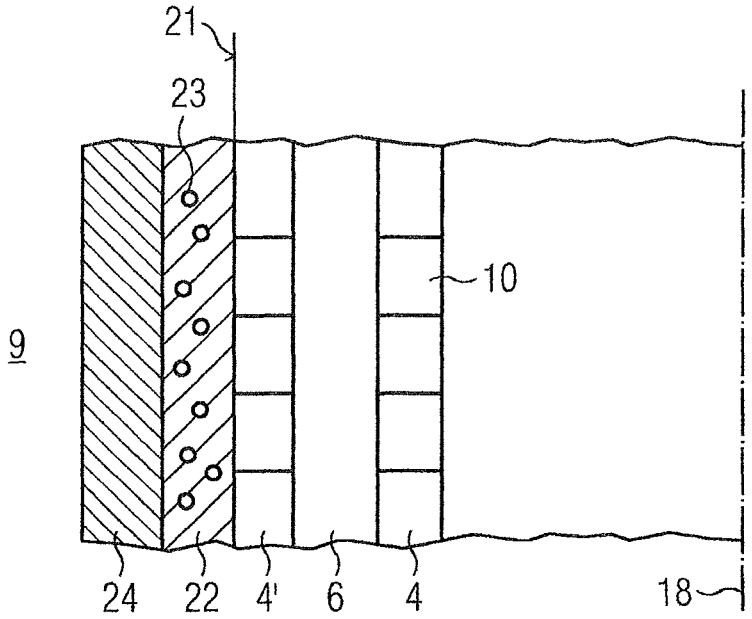
FIG. 4 is a sectional representation through the winding arrangement of FIG. 2, wherein the layered structure on the outer winding layer is shown enlarged.

FIG. 4 shows a sectional representation through the winding arrangement of FIG. 2, where the layered structure on the outer winding layer 4' is shown enlarged. The lateral surface 21 of the outer winding layer 4' is coated with the semiconducting spray coating 22. The spray coating 22 contains a filler material. In FIG. 4, particles of the filler material are identified with the reference character 23. The filler material is composed of particles 23 of different materials. In the present exemplary embodiment, the composition of the filler material consists of a mixture of particles 23 of different materials formed from undoped silicon carbide and with antimony-doped tin oxide. Toward the exterior environment 9, the spray coating 22 is covered with a protective or covering layer 24 which consists of an RTV silicone.

Figure 5:
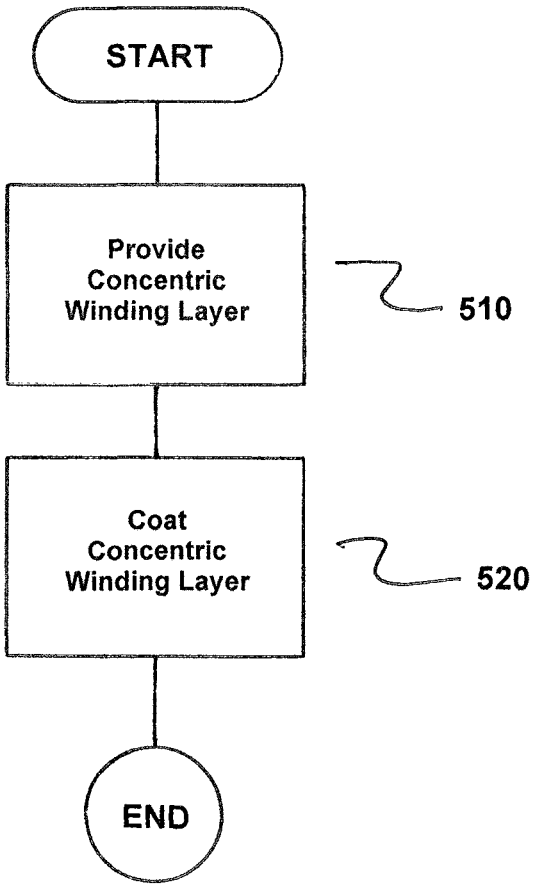
FIG. 5 is a flowchart of the method in accordance with the invention.

FIG. 5 is a flowchart of a method for producing a high voltage direct current energy transmission (HVDCT) air-core inductor. The method comprises providing at least one concentric winding layer 2, 3, 4, as indicated in step 510.

Next, the at least one concentric winding layer is coated on an outer lateral surface 21 via a spray coating method in which a layer 22 made of a semiconducting paint that is formed from an electrostatically dissipative material having a surface resistance in a region from 109 to 1014 ohm/square, as indicated in step 520.

Although the invention has been described and explained in detail on the basis of the two exemplary embodiments set out above, the invention is not restricted to these examples. Other embodiments and variations are conceivable without departing from the underlying concept of the invention.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A high voltage direct current energy transmission (HVDCT) air-core inductor, comprising:

at least one concentric winding layer having electrical terminals formed at ends thereof;

an electrostatic screen, comprising an outermost layer made of electrostatically dissipative material which has a surface resistance in a region of $10^9$ to $10^{14}$ ohm/square, the layer being provided at least at one end with a collector electrode extending over a periphery of the layer for connection at one terminal of the electrical terminals;

wherein the outermost layer is formed as a continuous circumferentially arranged coating disposed along a longitudinal axis of the air-core inductor, said coating having no abutment site or circumferential overlap on a lateral surface of an externally arranged winding layer.

2. The air-core inductor as claimed in claim 1, wherein the outermost layer has a layer thickness of between 80 μm and 120 μm.

3. The air-core inductor as claimed in claim 1, wherein the outermost layer comprises a polymer matrix with embedded filler materials comprising one of (i) an epoxy resin, (ii) a polyurethane, (iii) a silicone and (iv) a polyester.

4. The air-core inductor as claimed in claim 3, wherein the filler materials are formed by particles made from one of (i) metal oxide and (ii) silicon carbide.

5. The air-core inductor as claimed in claim 3, wherein the filler materials are formed by particles made from one of (i) doped metal oxide and (ii) doped silicon carbide.

6. The air-core inductor as claimed in claim 3, wherein the filler materials are formed by particles made from undoped silicon carbide and tin oxide doped with antimony.

7. The air-core inductor as claimed in claim 1, wherein the outermost layer is covered with a cover layer.

8. A method for producing a high voltage direct current energy transmission (HVDCT) air-core inductor, comprising:

providing at least one concentric winding layer; and coating the at least one concentric winding layer on an outer lateral surface of the at least one concentric winding layer via a spray coating method in which an outermost layer made of a semiconducting paint which is formed from an electrostatically dissipative material having a surface resistance in a region from $10^9$ to $10^{14}$ ohm/square;

wherein the outermost layer is formed as a continuous circumferentially arranged coating disposed along a longitudinal axis of the air-core inductor, said coating having no abutment site or circumferential overlap on the outer lateral surface of the at least one concentric winding layer.

9. The method as claimed in claim 8, wherein the outermost layer is formed via a low pressure (HVLP) spraying method.

10. The method as claimed in claim 8, wherein the outermost layer has a layer thickness of between 80 μm and 120 μm.

11. The method as claimed in claim 9, wherein a compressed air with an air pressure of 3-4 bar is utilized during the low pressure spraying method to atomize the material.

* * * * *